US008967395B1

(12) United States Patent
Lorenzana

(10) Patent No.: US 8,967,395 B1
(45) Date of Patent: Mar. 3, 2015

(54) GOLF CLUB SHAFT CLAMP

(71) Applicant: Vance A. Lorenzana, Oswego, IL (US)

(72) Inventor: Vance A. Lorenzana, Oswego, IL (US)

( * ) Notice: Subject to any disclaimer, the term of this patent is extended or adjusted under 35 U.S.C. 154(b) by 0 days.

(21) Appl. No.: 13/734,095

(22) Filed: Jan. 4, 2013

(51) Int. Cl.
*A63B 55/00* (2006.01)
*A47F 7/00* (2006.01)

(52) U.S. Cl.
CPC ..... *A47F 7/0021* (2013.01)
USPC ..... 211/70.2; 248/316.7

(58) Field of Classification Search
USPC ..... 211/60.1, 62, 63, 64, 65, 66, 68, 69, 211/69.1, 69.2, 69.8, 69.9, 70.2, 70.3, 70.4, 211/70.5, 70.6, 70.7, 70.8, 85.7, 120; 248/229.1, 229.13, 229.2, 229.22, 248/229.24, 230.5, 230.6, 231.61, 231.71, 248/316.1, 316.4, 316.6, 316.7; 269/3, 6, 269/43, 45, 143, 249
See application file for complete search history.

(56) References Cited

U.S. PATENT DOCUMENTS

| | | | | | |
|---|---|---|---|---|---|
| 365,282 | A * | 6/1887 | Tillman | 248/515 |
| 420,592 | A * | 2/1890 | Dayton | 248/514 |
| 975,246 | A * | 11/1910 | Johnson | 223/111 |
| 980,742 | A * | 1/1911 | Bartholomew | 248/324 |
| 1,342,136 | A * | 6/1920 | Smith | 248/229.1 |
| 2,130,650 | A * | 9/1938 | Peterson | 248/514 |
| 2,289,592 | A * | 7/1942 | Riedi | 248/514 |
| 2,527,435 | A * | 10/1950 | Little et al. | 248/316.7 |
| D177,955 | S * | 6/1956 | Arbogast | D8/355 |
| 3,056,412 | A * | 10/1962 | Wolfe | 131/328 |
| 3,131,900 | A * | 5/1964 | Anderson et al. | 248/210 |
| 4,159,773 | A * | 7/1979 | Losenno | 211/70.6 |
| 4,270,724 | A * | 6/1981 | McMullen | 248/534 |
| 5,456,437 | A * | 10/1995 | Chander et al. | 248/316.7 |
| D417,612 | S * | 12/1999 | Jones | D8/395 |
| 6,224,438 | B1 | 5/2001 | Hase | |
| 6,302,280 | B1 * | 10/2001 | Bermes | 211/70.6 |
| 6,398,175 | B1 * | 6/2002 | Conner et al. | 248/228.3 |
| 8,056,736 | B2 | 11/2011 | Dientsmann | |
| 8,117,077 | B2 | 2/2012 | Lin | |
| 2003/0010734 | A1 * | 1/2003 | Bermes | 211/70.6 |
| 2006/0011566 | A1 * | 1/2006 | Guy | 211/60.1 |
| 2006/0091089 | A1 * | 5/2006 | Christiansen et al. | 211/70.2 |
| 2008/0190795 | A1 * | 8/2008 | Shearon | 206/315.2 |
| 2009/0026155 | A1 * | 1/2009 | Bernard | 211/70.6 |

* cited by examiner

*Primary Examiner* — Joshua Rodden
(74) *Attorney, Agent, or Firm* — James N. Videbeck

(57) ABSTRACT

A golf club shaft holder assembly includes an adjustable base clamp member suitable for mounting to a vertical support rod of the canopy of a golf car, the spine of a golf bag cart or a suitable vertical portion of a golf bag. A sling shot shape shaft holder is mounted on the adjustable base clamp member and provides a pair of spaced apart C-shape clip members positioned thereon, capable of retaining the shaft of a desired, frequently used golf club thereon. A pair of Y-shape shield members are mounted adjacent the distal ends of the cross member to protect the C-shape clamps. The entire assembly includes a new means for selectably releaseably mounting a frequently used or desired golf club in a position which is easily accessible to a golfer for ease of use thereof.

4 Claims, 3 Drawing Sheets

GOLF CLUB SHAFT CLAMP

This invention relates to a golf club clamp, and, more particularly, to a dual position spaced-apart clamp suitable for clamping a frequently used golf club in close spatial relation to a golf cart canopy support, golf bag, or the like.

BACKGROUND OF THE INVENTION

Aids and accessories for golfers are quite numerous. Applicant's own copending application U.S. Ser. No. 13/287,010 for "Portable Golf Car Accessory Organizer," has won award for being the golf accessory of the year 2012 by one specialty trade association.

Building upon applicant's prior success and the realization that golfers often have favorite, most used, clubs, especially putters, applicant has recognized a need for providing easy and quick user access to such favored clubs. Prior existing apparatus for mounting individual golf clubs for both display in stores and use on the golf course can be found at U.S. Pat. Nos. 8,056,736; 6,224,438; and 8,117,077. The golf club holders disclosed above provide for securing the head of a golf club to the holder. As such, such holders or clamps are sized to fit clubs with larger heads, such as woods, with the ability to fit irons thereon being a secondary consideration. Generally, apparatus that clamps to a golf club shaft are small portable items for analyzing one's swing, or the like.

A need has developed for an apparatus for mounting an often-used golf club, whether it be a wood, iron or putter, in an easily-accessible relatively fixed position whether on a golf car, golf cart or golf bag.

SUMMARY OF THE INVENTION

The invention resides in a golf club shaft holder comprising a generally sling shot shape base including a central post portion and a cross portion extending perpendicularly from one end of said post portion centrally thereon. A spatially related pair of resilient generally C-shape retainers are mounted in aligned relation adjacent the respective opposed ends of the cross portion, and each said C-shape retainer includes a resilient distal opening.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENT

The Adjustable Base Clamp Member

Figure 1:
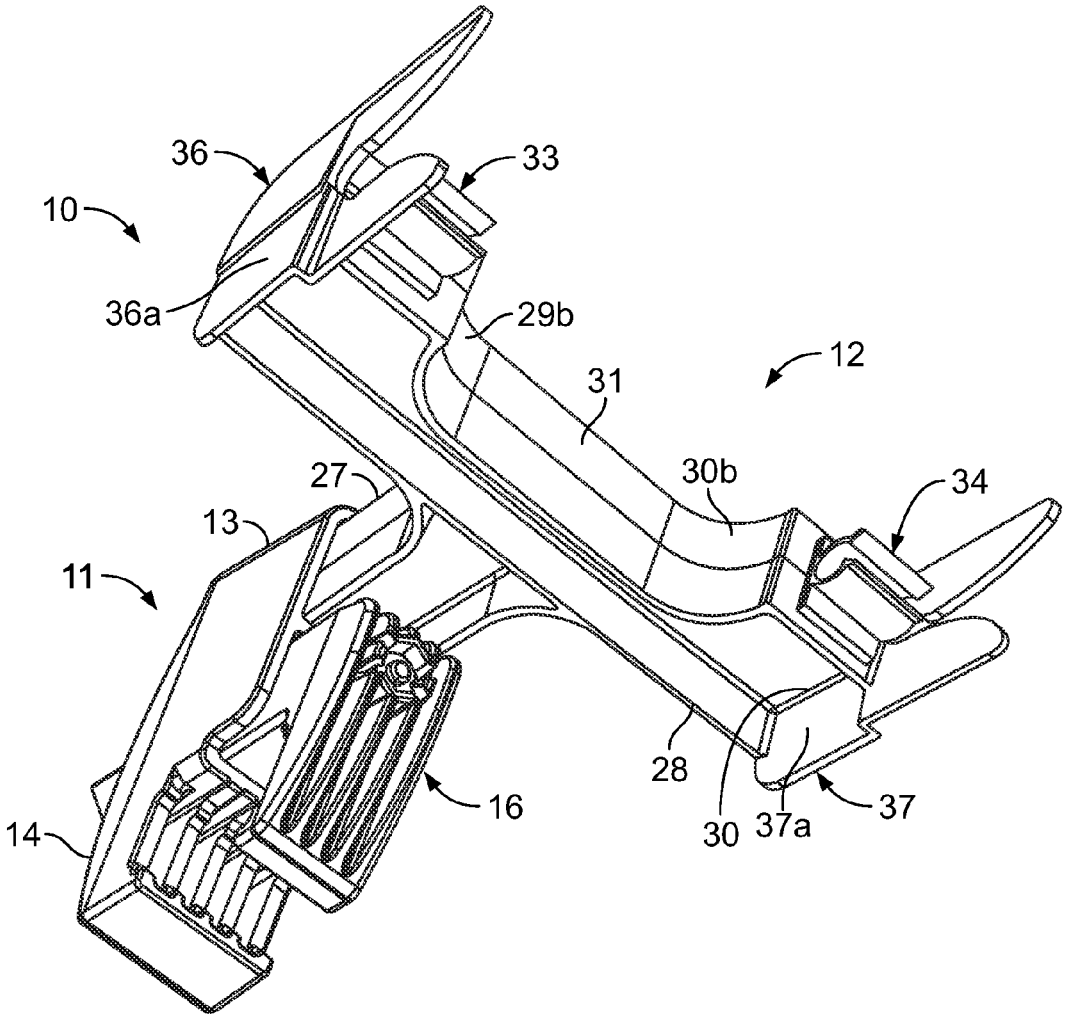
FIG. 1 is a three-quarter top perspective view of a golf club shaft mounting assembly constructed in accordance with the present invention.

Referring to FIG. 1, the golf club shaft holder assembly, generally indicated at 10, includes a base clamp member, generally indicated at 11, and a sling shot shape or generally U-shape shaft holder member having a central post depending centrally therefrom, generally at 12. The adjustable clamp member 11 is made up of a generally rectangular hollow post mounting portion 13, an upwardly open claw shape portion 14, and a hollow reverse claw slidable mounting portion 15. Clamp member 11 is, in the preferred embodiment, 3¾ inches in length, 1¼ inch in width, and 2 inches in height.

A reverse claw member, generally indicated at 16, includes a generally rectangular base 17 and a distal downwardly open claw shape portion 18. An elongate threaded screw type fastener generally indicated at 20, includes, in this preferred embodiment a triangulated thumb screw portion 21, an elongate threaded 3/16 inch rod 22 and a threaded nut 23.

The fastener 20 extends through the hollow reverse claw mounting portion 15 of the base clamp member 11 by passing through an aperture 24 in the adjustable base clamp member reverse claw mounting portion 16, thereafter and through the hollow interior of that portion, through a hollow interior of the reverse claw rectangular base 17 and thence through a second aperture 25 adjacent the top of the reverse claw mounting portion 17.

With the threaded nut 23 nested in the top of the reverse claw so that it cannot turn, twisting the thumbscrew 21 of the adjustable elongate fastener 20 moves the reverse claw 16 vertically up and down to open or close the combination of the distal claw portion 14 and the complementary shaped reverse claw portion 18 to allow the adjustable base clamp member 11 to be selectably releaseably mounted to any one of a plurality of external members (not shown) that may include a vertical canopy post on a golf car, vertical spine on a golf club cart, or a vertical portion of a golf bag, or the like.

The reverse claw member 16 is, in the preferred embodiment, a 1 inch×1 inch base 1/3;16 high with the reverse claw being 1/7;8 inch high overall and 2 3/16 inch in overall length. Each claw portion being 1 3/16 inch in length.

It should be noted that the preferred position for the adjustable base clamp member 11 is with the complementary claw members positioned horizontally so that the hollow inner complementary claw portions thereof grasp a vertical support member, such as a post supporting the canopy over the top of a golf car (not shown). For reasons that will be discussed in greater detail below, it should also be noted that this adjustable base clamp member 11 is fully described in my copending application Ser. No. 13/287,010.

The Golf Club Shaft Holder

The golf club shaft holder 12 may be considered a generally sling shot shape or Y-shape member or a generally C or U shape member 28 having a central post 27 depending from the bight portion of that C or U shape member. Holder 12 is 5 7/16 inches in length and 6 7/16 inches in total height. A shaft holder is deemed to be simpler to make and more versatile than prior known club head holders.

The sling shot shape shaft holder, generally indicated at 12, includes a generally rectangular central post 27 (15/16×15/16 inch in cross section and 3 7/16 inches in length) whose distal end fits in the generally hollow rectangular post mounting portion 13 of adjustable base clamp member 11 and is retained therein by screw 40. Extending from the top of central post 27 and positioned generally perpendicular thereto, is a cross member 28 that has opposed distal ends 29 and 30 and is 5/16 inches in length by 3/4 inch thick. A preferred material is aluminum or plastic.

Each of the opposed distal ends 29 and 30 of cross member 28 includes a raised or pedestal portion 29*a*, 30*a*, respectively, that is raised with each respective inner curved wall 29*b*, 30*b*, defining a central bight portion 31 providing a space for a user's fingers to be positioned therethrough when grasping a golf club shaft (not shown) mounted parallel to the cross member, as will be described in more detail below.

Figure 2:
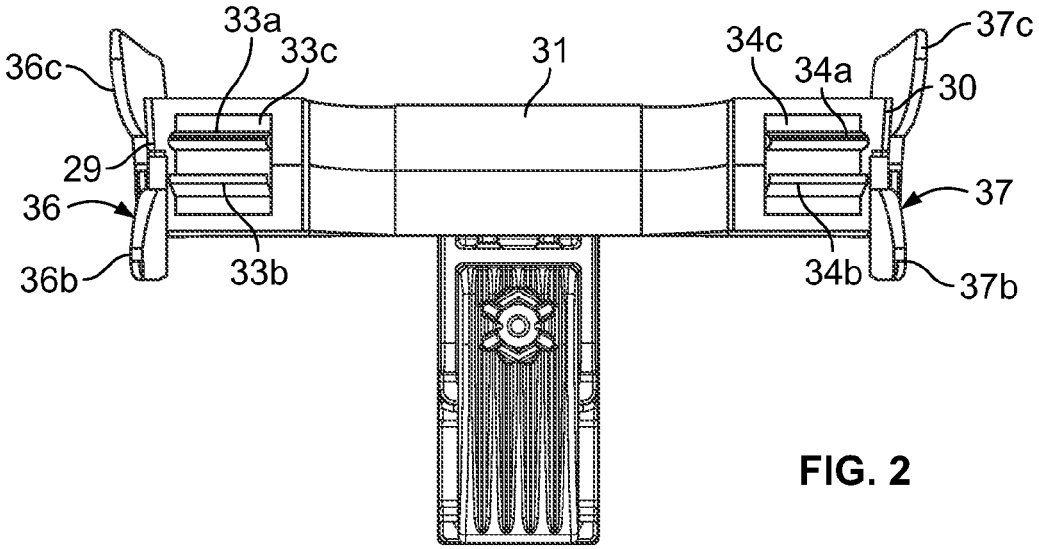
FIG. 2 is a top plan view of the golf club shaft holding assembly shown in FIG. 1.
Figure 3:
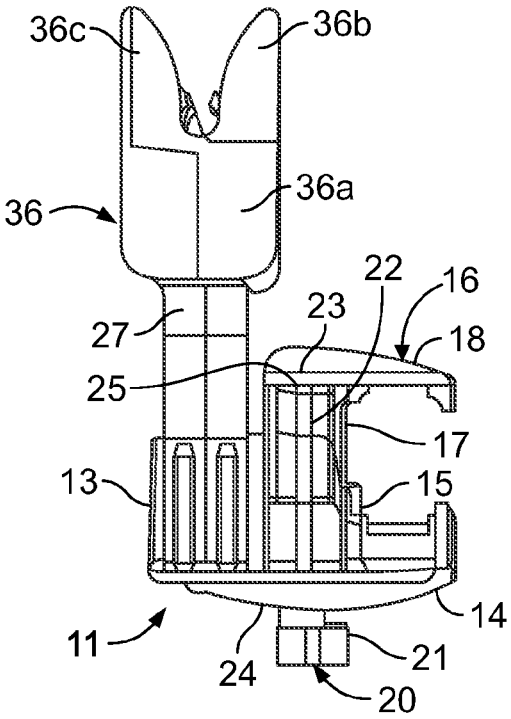
FIG. 3 is an end elevational view of the golf club shaft clamp shown in FIG. 1.
Figure 4:
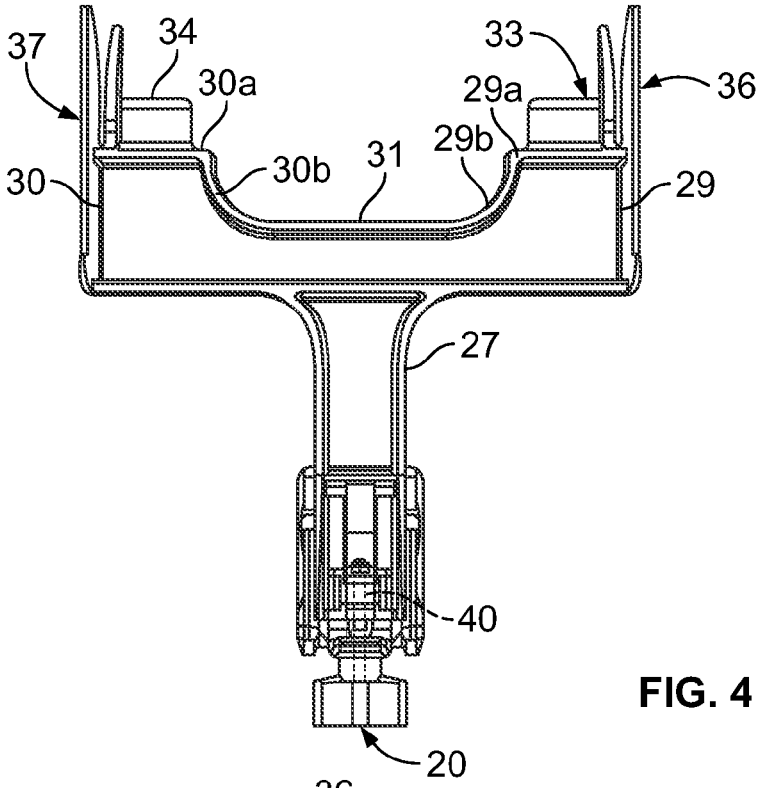
FIG. 4 is a back elevational view of the golf club shaft clamp shown in FIG. 1.
Figure 5:
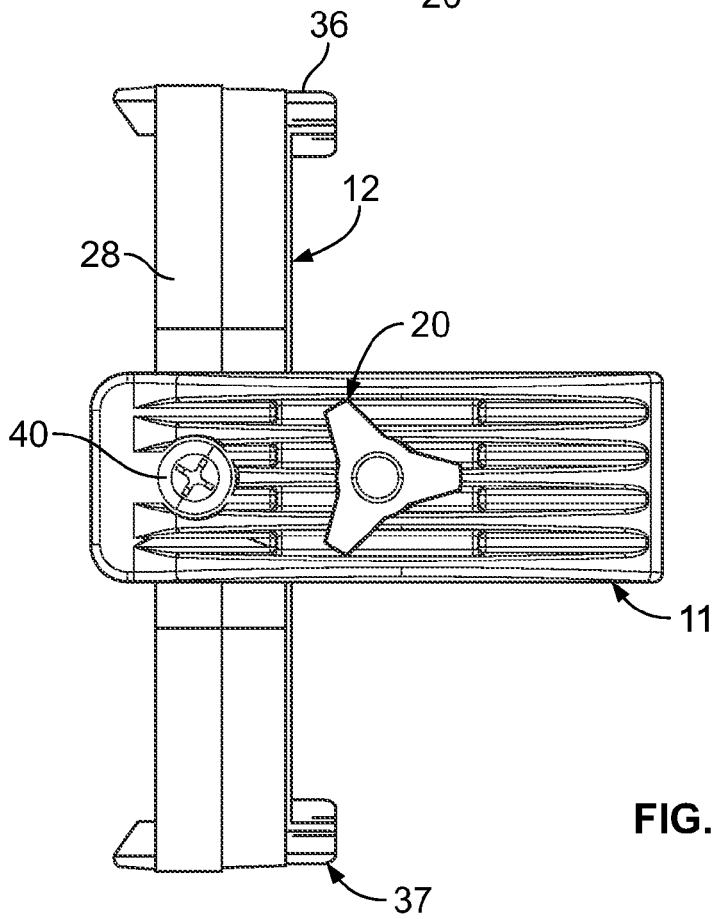
FIG. 5 is a bottom plan view of the golf club shaft clamp shown in FIG. 1.

On the top of each of the opposed pedestal portions 29*a*, 30*a*, is mounted a C shape resilient clip member 33, 34, respectively. These resilient clip members 33, 34, shown most clearly in FIGS. 1, 2 and 4, are preferably made of spring steel, plastic or the like, and have resilient arms, 33*a*, 33*b* and 34*a*, 34*b*, respectively, sized to selectably releasably retain therebetween the shaft of a desired golf club (not shown). On the preferred embodiment, each C shape clip is 1/2 inch in height, 3/4 inch in length and its opposed arms define a 3/8 inch void therebetween at their widest, coming together to 3/16 inch at their narrowest spatial relation and flaring outwardly to 3/8 inch between the distal ends of the respective arms.

Each of the C shape retainers includes a generally flat 3/4 inch by 3/4 inch base 33*c*, 34*c*, respectively, extending from the bight portion of each of the clips. In order to protect the assembly, a pair of opposed, generally Y-shape shield members 36, 37, respectively, are attached to the distal ends 29 and 30 of the cross member 28. The shields each include a base 36*a*, 37*a* and a pair of spaced apart wings 36*b*, 36*c*, 37*b*, 37*c*, respectively, the bight portion thereof between each respective pair of wings at 1/2 inch apart being sized to accept a golf club shaft positioned therethrough. Each bight portion space is aligned with the hollow interior of each of the C-shape clips 33, 34. The shields protect the C-shape clips and prevent damage to the cross member 28 portion of the golf club shaft holder assembly 10.

With the adjustable base clamp member mounted on a desired golf car canopy support, the spine of a golf bag cart or a suitable portion of a golf bag, the cross member 28 is preferably positioned generally vertically so as to provide for convenient acceptance and selectable retention of a desired frequently used golf club with its shaft retained in the C-shape clip members for ease of mountability and removability therefrom.

While one embodiment of the invention has been shown and described it will be apparent to those skilled in the art that changes and modifications may be made without departing from the true spirit and scope of the present invention. It is the intent of the appended claims to cover all such changes and modifications as fall within the true spirit and scope of the invention.

What is claimed:

1. A golf club shaft holder comprising:

a generally sling shot U-shape base including a central post portion, a cross portion extending perpendicularly from one end of said post portion centrally thereon, a spatially related pair of resilient generally C-shape retainers mounted in aligned relation adjacent respective opposed ends of said cross portion, an opening on each said C-shape retainer, each of said opposed ends of said cross portion further including:

a generally Y shape guard member with a bight portion of each said guard member is aligned with each of said C-shape retainers.

2. The golf club shaft holder as defined in claim 1 wherein each said guard member is mounted perpendicular to said cross portion, including a mounting portion being wider than a thickness of said cross portion, and a pair of spaced apart opposed arms extending upwardly from said mounting portion higher than the height of said cross member and said C-shape retainer.

3. A golf club shaft holder comprising:

a generally sling shot U-shape base including a central post portion, a cross portion extending perpendicularly from one end of said post portion centrally thereon, a pair of opposed pedestal portions adjacent respective opposed ends of said cross portion on a side of said cross portion opposite said central post portion, a spatially related pair of resilient generally C-shape retainers mounted in aligned relation adjacent the respective pedestal portions on the opposed ends of said cross portion, an opening on each said C-shape retainer, and a generally Y-shape guard member mounted on each of said opposed ends of said cross portion, with a bight portion of each said guard member being aligned with a central void inwardly adjacent said opening on each of said C-shape retainers.

4. The golf club shaft holder as defined in claim 3 further including:

an adjustable clamp member having a base including a generally rectangular hole therein sized for receiving said central post portion therein and a first claw shape portion extending from said base, a second reverse shape claw member, and an adjustable fastener connecting said first claw shape portion and said reverse shape claw member.

* * * * *